US009259065B2

(12) United States Patent
Wingerter et al.

(10) Patent No.: US 9,259,065 B2
(45) Date of Patent: Feb. 16, 2016

(54) CASE FOR COINS AND/OR PLASTIC CARDS

(76) Inventors: Thomas Wingerter, Hamburg (DE); Katrin Mengel, Hamburg (DE)

( * ) Notice: Subject to any disclaimer, the term of this patent is extended or adjusted under 35 U.S.C. 154(b) by 332 days.

(21) Appl. No.: 13/520,458

(22) PCT Filed: Jan. 5, 2011

(86) PCT No.: PCT/EP2011/000016

§ 371 (c)(1),
(2), (4) Date: Oct. 9, 2012

(87) PCT Pub. No.: WO2011/083078

PCT Pub. Date: Apr. 14, 2011

(65) Prior Publication Data

US 2013/0025750 A1 Jan. 31, 2013

(30) Foreign Application Priority Data

Jan. 5, 2010 (DE) ..... 20 2010 000 921 U

(51) Int. Cl.

| | |
|---|---|
| ***A45C 1/06*** | (2006.01) |
| ***A45C 1/02*** | (2006.01) |
| ***A45C 11/18*** | (2006.01) |
| *A45C 13/10* | (2006.01) |
| *A45C 1/08* | (2006.01) |

(52) U.S. Cl.

CPC ..... *A45C 1/02* (2013.01); *A45C 11/182* (2013.01); *A45C 13/1084* (2013.01); *A45C 2001/028* (2013.01); *A45C 2001/083* (2013.01)

(58) Field of Classification Search

CPC .... A45C 11/82; A45C 1/04; A45C 2001/067; A45C 15/00; A45C 11/182; A45C 1/06

USPC ..... 150/131, 136, 137, 147–150; 220/521, 220/531, 525; 206/0.83, 37, 37.4, 39, 581; 190/112, 119, 111

See application file for complete search history.

(56) References Cited

U.S. PATENT DOCUMENTS

| | | | | | |
|---|---|---|---|---|---|
| 439,086 | A | * | 10/1890 | Albright | 150/150 |
| 1,223,946 | A | * | 4/1917 | Fenigstein | 206/37 |
| 1,704,285 | A | * | 3/1929 | Dunn et al. | 150/153 |
| 2,298,945 | A | * | 10/1942 | Hyatt | 150/136 |
| 2,612,200 | A | * | 9/1952 | June | 150/136 |
| 2,669,641 | A | * | 2/1954 | Becker | 219/387 |
| 2,869,603 | A | * | 1/1959 | Conley | 150/150 |
| 3,062,364 | A | * | 11/1962 | Ziemski | 220/4.24 |
| 4,020,930 | A | * | 5/1977 | Weber | 190/108 |
| 4,176,491 | A | * | 12/1979 | Herring | 43/57.1 |
| 5,370,419 | A | * | 12/1994 | Takayama | 281/31 |

(Continued)

FOREIGN PATENT DOCUMENTS

| | | |
|---|---|---|
| DE | 818833 | 10/1951 |
| DE | 3314535 A1 | 10/1984 |

(Continued)

*Primary Examiner* — Sue A Weaver
(74) *Attorney, Agent, or Firm* — Vidas, Arrett & Steinkraus

(57) ABSTRACT

The invention relates to a case for coins or plastic cards or documents or similar items with a first and a second hard shell, a joint, pivotally connecting the first and the second hard shell to each other at the edges thereof, a center part pivotally connected to the first and the second hard shell by means of the joint, means for selectively locking the center part to the first hard shell and to the second hard shell.

16 Claims, 17 Drawing Sheets

(56) References Cited

U.S. PATENT DOCUMENTS

| | | | | |
|---|---|---|---|---|
| 6,385,897 | B1 | 5/2002 | Klabunde | |
| 7,293,589 | B2 * | 11/2007 | Boyarski | 150/153 |
| 7,918,335 | B1 * | 4/2011 | Kitchen | 206/38 |
| 2003/0037851 | A1 * | 2/2003 | Hogganvik | 150/147 |
| 2010/0314011 | A1 * | 12/2010 | Chen | 150/149 |

FOREIGN PATENT DOCUMENTS

| | | |
|---|---|---|
| DE | 41 19 792 C2 | 6/1994 |
| FR | 1534935 | 8/1968 |

* cited by examiner

CASE FOR COINS AND/OR PLASTIC CARDS

CROSS-REFERENCE TO RELATED APPLICATIONS

This is a national stage application of PCT/EP2011/000016, filed Jan. 5, 2011, the entire contents of which are hereby incorporated by reference.

STATEMENT REGARDING FEDERALLY SPONSORED RESEARCH

Not applicable.

BACKGROUND OF THE INVENTION

The present invention relates to a case for coins and/or plastic cards or similar items.

Wallets are mostly made of leather or plastics. Today, there are different shapes according to requirements. Most widespread are wallets for men in horizontal or vertical formats, which are collapsible and have a size of about 12.5×10 cm in the closed condition. When opened, they provide space for banknotes across their overall length and contain other compartments for credit cards and other plastic cards, visiting cards and identity cards, which can be optionally swung out. In Europe, a compartment for coins is also a part of the usual configuration. Men often wear their billfold in a backside pocket of their trouser, and therefore the backside pockets are adapted to the above-mentioned size. A large diversity of shapes and colours exists amongst wallets for women. Many models are similar in shape to the above-described wallets for men. However, there are also considerably larger exemplars which offer significantly more space.

Billfolds are flat containers for identity cards, paper money, folded documents and other items, having front pocket size and mostly being foldable together. Billfolds are made of leather, sometimes also of textile cloth, and are often worn in the inner front pockets of men's jackets. The dimensions of the jacket's inner pockets and those of the billfolds are mostly adapted to each other and amount to somewhat more than a doubly folded DIN A4- or one DIN A6 format respectively, thus, about 17×12 cm in length and width.

Document DE 33 14 535 A1 describes a case with two flat half-shells, pivoting about an axis and designed essentially uniformly. The half-shells are movable along an axis and can be clicked together by means of a locking device. In this, the half-shells can be shifted and closed against the force of a spring arranged around the pivot pin. According to an embodiment, an insert is attached in one half-shell, which has bridges with T-shaped cross section which function for retaining coins of different size. The coins can be thrust in and out via openings which are provided in the front side of the half-shell. The bridges have a portion running parallel to the bottom of the half-shell, which is provided with interrupted, parallel slits on both sides of that portion which runs vertical to the former portion. The slits enable to bend out the vertically running portion in the region of the largest diameter of a thrust-in coin, and thus its captive lateral retaining.

The other half-shell has an insert with an elastically designed clamp with fingers, by which e.g. an identity card or a credit card is held.

In this case, insertion and take-out of single coins is laborious. The retainer of the credit card is unsafe, and insertion and take-out of a credit card can result in that other items that are held by the clamp will fall out.

Document DE 41 19 792 C2 describes a portable, expandable container made of plastics, a multi-purpose portfolio in billfold format in particular, for accommodating coins, cheque cards, visiting cards and identity cards in particular. The container has two half-shells, connected to each other by means of an elastic back joint. The elastic back joint is designed as a roll back joint consisting of a one-piece sequence of a plurality of film joint single joints. The roll back joint consists of plastics and has alternating grooves and longitudinal bridges, the grooves causing the elastic bending property on the grooves, and the stability and rigidity on the longitudinal bridges. The container is preferably a two-materials piece, the half-shells consisting of a correspondingly hard material, whereas a second, softer plastics is used for the back joint. But however, the container can be made from one single material or substance, so that one may arrive at a compromise solution which provides a too soft material for the half-shells, and a too hard material for the roll back joint.

BRIEF SUMMARY OF THE INVENTION

According to one embodiment of the container, one of the half-shells has holding blocks in the region of the roll back joint, into which some flat accommodation envelopes are inserted so as to be turnable over like book pages. The accommodation envelopes form pockets into which small parts can be inserted. It may be dealt with RAM cards, diskettes or other flat parts in this, which are thrust into the pockets and are clamped fast in these accommodation pockets by springy, downward bent clamping bridges. The pockets can also accommodate coins, post stamps, but also cheque cards, visiting cards and the like. After opening the plastics container, it is possible to turn over the single hangers one after the other.

In the known container, it is disadvantageous that the items can easily fall out of the pockets after the opening. Moreover, it is awesome to take out single coins selectively with defined value from one of the pockets into which several coins are filled in.

Starting from this, the present invention is based on the task to provide a case for coins and/or plastic cards or similar items which permits safe, protected and space-saving custody and easy take-out of the items, the danger being reduced that items fall out without intent.

This task is achieved by a case with the features of claim 1. Embodiments of the present invention are indicated in subclaims.

The case for coins or plastic cards or documents or similar items according to the present invention has

- a first and a second hard shell,
- a joint, pivotally connecting the first and the second hard shell to each other at the edges thereof,
- a centre part pivotally connected to the first and the second hard shell by means of the joint,
- means for selectively locking the centre part to the first hard shell and to the second hard shell.

In the case of the present invention, at least one accommodation for coins, cards, documents and other items exists between the centre part and the first hard shell and the centre part and the second hard shell, respectively. The means for locking are configured such that the centre part can be locked to the first and/or the second hard shell at option, and the locking of the centre part to the first and/or the second hard shell can be released at option. The user can use the means for locking in order to open or to close one of the accommodations at both sides of the centre part at option. This allows the user to retain items in the at least two accommodations separately, and to take out items from the accommodations or to insert them therein at option. The means for locking are for instance catches, which are formed at the centre part and at the first and at the second hard shell. The catches are for instance cooperating engagement edges at the edge of the centre part and the first and the second hard shells, or engagement hooks on the centre part, which co-operate with engagement edges on the hard shells, or reversely. Further, the means for locking are for instance spring means, which press the centre part and the first and the second hard shell together in the closing position, and permit to open the first and the second hard shell at option by swinging it away from the centre part overcoming a spring force. The opening position can be a stable position, in which the spring means do not swing the hard shells against the centre part.

The case for coins or similar items according to the present invention has

- a first and a second hard shell,
- a joint, pivotally connecting the first and the second hard shell to each other at the edges thereof,
- a coin retaining compartment for coins at the inner side of the first hard shell with a coin opening for the passage of coins,
- wherein the first and the second hard shell can be swung about the joint into a closing position, in which they encompass the coin retaining compartment, and can be swung into an opening position in which coins can be dumped out of the coin retaining compartment through the coin opening into the second hard shell, and in the reverse direction from the second hard shell into the coin retaining compartment, and
- means for locking the first to the second hard shell in the closing position.

The case of the present invention accommodates coins or similar items in the coin retaining compartment. When the first and the second hard shell are in the closing position, the coins are secured by the first and the second hard shell which encompass the coin retaining compartment. Preferably, the second hard shell locks up the coin opening of the coin retaining compartment, so that the coins are kept in the coin retaining compartment. When the first and the second hard shell are in the opening position, the coins can be dumped out of the coin retaining compartment to the inner side of the second hard shell from. Thereafter, the user can easily find those coins which he/she needs. Thereafter, he/she can dump back residual coins into the coin retaining compartment by swinging the case into a position where the second hard shell is above the first hard shell, and secure them by bringing the first and the second hard shell into the closing position and locking them to each other. In case that it is intended to fill in coins only, after having opened the case, the user puts them directly into the coin retaining compartment after opening the case, or puts them into the second hard shell and dumps them into the coin retaining compartment thereafter. For this purpose, according to a preferred embodiment, the coin opening is disposed in a side of the coin retaining compartment which is associated to the joint. The coin opening is preferably an oblong opening. Furthermore preferred, the coin opening extends over the whole side of the coin retaining compartment that faces the joint. The case of the present invention facilitates the handling and provides safe and space-saving custody for coins or similar items.

The coin retaining compartment may have different shapes. It is preferably designed box-like or approximately box-like. When the case is designed overall box-like or approximately box-like, the space encompassed by the first and the second hard shell is utilized as well as possible.

According to one embodiment, the coin retaining compartment has a height that permits to stack several coins of a defined currency (for instance Euro) one above the other. Preferably, two coins can be stacked one above the other. Still preferably, the height is dimensioned such that exactly several coins with defined values—in particular different values (for instance 1 Euro and 20 cents) can be stacked one above the other. But however, the invention embraces also embodiments in which the height of the coin retaining compartment is dimensioned such that only one layer of coins fits in, wherein the height can be adapted to the thickest coin of a certain currency (for instance, 2 Euro coins).

According to a preferred embodiment, the second hard shell has a smooth transition towards the joint at the inner side, and/or has a shoulder at the opposite end. The smooth or respectively rounded transition favours the dumping of the coins from the second hard shell into the coin retaining compartment. The shoulder catches the coins when they are being dumped into the second hard shell, so that they do not jump out of the case.

According to a further embodiment, the second hard shell is tapered towards the joint at its outer side. The tapering is material-saving, in particular when it corresponds to a soft transition towards the joint at the inner side of the hard shell. Moreover, the tapering facilitates the insertion of the case into a back pocket or into a jacket inner pocket. Preferably, the case has a further tapering at the opposite end of the second hard shell. The (further) tapering may be a flattening and/or rounding. In addition or instead, the first hard shell may be provided with a tapering at the ends at the outer side, for instance in the form of a flattening respectively rounding. Preferably, the first and/or the second hard shell have roundings on the further edges at the outside.

According to one embodiment, the coin opening is not covered up by the first shell edge of the first half-shell. As a consequence, a pass-over of coins between the coin retaining compartment and the second half-shell is not hindered by the first half-shell. In principle, the coin opening can also be disposed below the first shell edge of the first half-shell, wherein by means of a smooth transition between coin opening and first shell edge, it can be ensured that no coins pass over.

According to a further embodiment, a first clip is disposed on that side of the coin retaining compartment which faces the second hard shell. The clip serves preferably for fixing banknotes.

According to one embodiment, the case according to one of the claims 2 to 10 has the features of the case of claim 1.

The case for plastic cards or similar items of the present invention has

- a first and a second hard shell,
- at least one box-shaped card retaining compartment for at least one plastic card at the inner side of the second hard shell with a base area, adapted to the card dimensions and facing the second shell bottom of the second hard shell, and with an oblong card opening in a wall vertical to the base area for thrusting through a plastic card,
- a joint, pivotally connecting the first and the second hard shell to each other at the edges thereof, about which the first and the second hard shell can be swung into a closing position in which they encompass the card retaining compartment and about which the first and the second hard shell can be swung into an opening position in which plastic cards can be thrust through the card opening, and
- means for locking the first to the second hard shell in the closing position.

The case of the present invention accommodates at least one plastic card or similar items (like visiting cards, bonus cards, identity documents, traffic tickets for public transportation means (for instance HVV subscription cards e.g.), membership cards) in the card retaining compartment. According to this, the expression "plastic card" is intended to designate cards made of plastics as well as cards made of cardboard or other materials. The plastic cards can also be provided with magnetic stripes or RFID chips. When the first and the second hard shell are in the closing position, the plastic card is secured by the first and the second hard shell which encompass the card retaining compartment. Preferably, the second hard shell locks up the card opening of the card retaining compartment in this, so that the plastic card is kept in the card retaining compartment. When the first and the second hard shell are in the opening position, the plastic card can be taken out of the card retaining compartment. This is advantageous in particular when a stack of plastic cards is arranged in the card retaining compartment. The user can thrust out plastic cards and withdraw the desired plastic card form the card retaining compartment. After utilisation, the user can easily insert the plastic card into the card retaining compartment through the card opening, and secure it by bringing the first and the second hard shell into the closing position and locking them to each other.

The box-like shape of the card retaining compartment and its match with the card format ensure that the plastic card does not fall out without control, but can be taken out easily however. The card format is that of a standard cheque card (debit card or bank card, e.g.) or of a standard visiting card. A cheque card has a format of 85.60 mm×53.98 mm according to ISO/IEC 7810. In Europe, a standard visiting card has a format of 85 mm×54 mm, and in Asia a format of 90 mm×54 mm. When matched to the format of a European standard cheque card, the card retaining compartment can accommodate standard cheque cards as well as European standard visiting cards. When matched to the standard format of an Asian standard visiting card, the card retaining compartment can accommodate Asian and European standard visiting cards and standard cheque cards.

According to one embodiment, the case has one single card retaining compartment of the kind described above. According to another embodiment, it has several card retaining compartments of the kind described above.

According to one embodiment, the card opening is disposed at a side of the card retaining compartment turned away from the joint. This favours the unfolding of the case, without that the card opening arrives in a low position, in which the plastic card slips out of the card retaining compartment without the user's intent. For this purpose, the case must only be held with the first hard shell horizontally, and the second hard shell be swung upward.

According to a further embodiment, the card opening is not covered up by the second shell edge of the second hard shell. This facilitates the withdrawal and the insertion of the plastic card into the card retaining compartment. In principle, the second shell edge can cover up the card opening in a distance, and can be overcome by swinging the plastic card when it is taken out of the card opening. In order to facilitate this, a smooth respectively rounded transition may exist between the card opening and the second shell edge.

According to one embodiment, the card retaining compartment has at least one recess for thrusting out a plastic card in at least one wall. The user can push the plastic card out of the card opening through the recess. The at least one recess exists preferably in that wall of the card retaining compartment which is turned away from the second shell bottom of the second hard shell.

According to a further embodiment, the card retaining compartment has a height which is adapted to a stack of plastic cards. Through this, a space-saving accommodation of several plastic cards in one stack is made possible.

According to a further embodiment, a second clip is disposed on the inner side of the first hard shell. The second clip may serve for clamping fast visiting cards, receipts or notices, e.g.

According to a further embodiment, the first clip butts under prestress against the inner side of the second hard shell in the closing position, and/or the second clip butts under prestress against the card retaining compartment in the closing position. Through this, it is achieved that the first and the second hard shell spring open when the means for locking are being unlocked. This facilitates to open the case by grasping into an opened gap between the first and the second hard shell. In addition, the prestress can ensure that the first and the second hard shell are held in a defined position in the locked condition.

According to one embodiment, the case according to one of claims 11 to 16 has the features of the case of one of the claims 1 to 10.

According to one embodiment, the first coin retaining compartment for coins and/or a multi-compartment folder for documents and/or the card retaining compartment for plastic cards is/are disposed on a centre part (or carrier), which is pivotally connected to the first and the second hard shell by means of the joint. When the centre part is swung against the first hard shell and the second half-shell is unfolded, coins can be taken out from the coin retaining compartment or filled into it, or documents from the multi-compartment folder. When the centre part is swung against the second hard shell and the first hard shell is unfolded, plastic cards can be taken out or set in. The centre part separates the case into two halves, both of which can be utilised for retaining items.

The multi-compartment folder comprises several pockets, which can be flatly folded together and bellows-like unfolded, like at known arrangement systems from the office, which are known as "fan-like folders" and "fan-like portfolios". The multi-compartment folder is preferably attached to the centre part with an outer pocket wall, which limits an outer pocket at the outside. The multi-compartment folder is preferably attached to the inner side of the second hard shell with the other outer pocket wall, which limits the other outer pocket at the outside. By swinging the second hard shell upward, the multi-compartment folder can be fanned out. For this purpose, the openings of the multi-compartment folder are preferably at the side turned away from the joint of the case. The outer pocket walls of the multi-compartment folder are preferably attached to the centre part and respectively to the second hard shell by glueing. The pockets of the multi-compartment folder can be used for the accommodation of an identity card, a driving licence, receipts, banknotes and other documents. In principle, coins can also be filled into the pockets of the multi-compartment folder.

According to a further embodiment, at least one holding finger exists between the centre part and a hard shell, which is pivotally connected to the first hard shell and the second hard shell by means of the joint or by means of a further joint parallel to it. The finger is preferably arranged between the centre part and the second hard shell. The finger serves for the custody of an identity card, a driving licence, of receipts, banknotes and other documents. Several fingers are preferably arranged pivotally between the centre part and the hard shell. Further preferably, several fingers are arranged pivotally next to each other on a common shaft or pivot pin, and/or are coupled with each other by take-along devices, so that when a finger is swung about a certain angle, a neighbouring finger is taken along with it by the take-along devices, and as the case may be, this second finger takes along a further finger when it is swung about a certain angle, and so on. The take-along devices can be stops on the neighbouring front sides of bearing eyes of neighbouring fingers, which hit each other when one of the neighbouring fingers is swung about a certain angle.

According to one embodiment, a case having fingers for holding documents is provided with fan-like unfoldable guiding means laterally next to the fingers, which prevent lateral falling out of documents.

According to a preferred embodiment, the coin retaining compartment or the multi-compartment folder or at least one finger is disposed on a first side of the centre part, and the card retaining compartment on a second side of the centre part opposite to the first side. The case is then suitable for retaining coins or documents as well as plastic cards. The advantages of both variants of the present invention are combined in one single case.

But in principle it is also possible to design the centre part only with a coin retaining compartment or a multi-compartment folder or a card retaining compartment at one side, or to arrange only at least one finger at one side of the centre part, and to dispose none of these retaining devices at the other side of the centre part. In this case, at the side not provided with one of these retaining devices, the centre part can encompass an accommodation in the case which can be used to retain further items.

Furthermore, the present invention protects embodiments in which the same retaining devices (i.e., coin retaining compartment, multi-compartment folder, finger or card retaining compartment) are disposed on both sides of the centre part. Further, the present invention comprises embodiments which have several same or different ones of the mentioned retaining devices. The other side of the centre part can be configured without retaining device, or with only one or several same or different retaining devices.

According to one embodiment, the case has means for locking the first hard shell to the second hard shell. The means for locking the first hard shell to the second hard shell are for instance designed like the means for locking the centre part to the first hard shell and the second hard shell, which have been explained above, i.e. as catches or spring means between the first and the second hard shell.

According to one embodiment, the case has means for locking the centre part to the first hard shell. By locking the centre part to the first hard shell, it is prevented that the centre part swings away form the first hard shell, whereby the withdrawal and the supply of coins is facilitated. According to a further embodiment, the case has means for locking the centre part to the second hard shell. By locking the centre part to the second hard shell, it is prevented that the centre part swings with respect to the second hard shell, whereby the withdrawal and the supply of plastic cards is facilitated. By unlocking the first or the second hard shell at option, selective access can be obtained to the different retaining devices.

According to a preferred embodiment, the means for locking the first to the second hard shell have means for locking the centre part to the first hard shell, and means for locking the centre part to the second hard shell. By means of the means for locking, the centre part can be locked to the first hard shell as well as to the second hard shell, in order to lock the first to the second hard shell in the closing position. Further, it is possible to release the means for locking the centre part to the first hard shell in order to swing up the first hard shell. Thereafter, there is access to the plastic cards. If to the contrary, the centre part is locked to the first hard shell and the locking to the second hard shell is released, access to the coins is possible. In the access, an uncontrolled movement of the centre part is prevented by the respective existing locking to the first or the second hard shell.

According to a further embodiment, the means for locking have at least one engagement hook and at least one engagement contour that can be brought into engagement therewith, at least one spring means for loading the engagement hook into the engagement position on the engagement contour, and at least one press button for disengaging the engagement hook and the engagement contour. The at least one engagement hook and the at least one engagement contour are disposed on different pivotal parts, for instance on the first hard shell and the second hard shell or on the centre part and the first hard shell and the second hard shell. The push button is loaded or moved, respectively, into a starting position by the spring means.

According to a preferred embodiment, the means for locking have a first press button, which is pivotally mounted on the first hard shell on a first hinge bearing, a second press button, which is pivotally mounted on the second hard shell on a second hinge bearing, a first engagement hook rigidly connected to the first press button and being loaded into a position of engagement with a first engagement contour on the centre part by means of first spring means, a second engagement hook rigidly connected to the second press button and being loaded into a position of engagement with a second engagement contour on the centre part by means of second spring means, so that the first engagement hook can be brought into disengagement from the first engagement contour by actuating the first press button against the spring action of the first spring means, and the second engagement hook can be brought into disengagement from the second engagement contour by actuating the second press button against the spring action of the second spring means.

According to an alternative embodiment, the case has one single push button, by which the locking between the first hard shell and the centre part and the locking between the second hard shell and the centre part can be released at option. The common push button is present on the centre part e.g., and it cooperates with engagement contours on the first hard shell and the second hard shell by means of first and second engagement hooks which are rigidly connected to the common push button. The common push button may be a rocker push button in particular.

According to a further embodiment, the first spring means is a first flexible spring rigidly connected to the first press button, and the second spring means is a second flexible spring rigidly connected to the second press button. The first spring means is preferably supported on the first hard shell, and the second spring means on the second hard shell.

Furthermore preferably, the first spring means and/or the first engagement hook is designed integral with the first push button, and/or the second spring means and/or the second engagement hook is designed integral with the second push button.

According to a further embodiment, the first and/or the second hard shell comprise at least one housing for an MP3 stick and/or notepad and/or pocket calculator and/or calendar and/or mirror and/or miniature tools and/or manicure. According to a further embodiment, the case comprises a MP3 stick and/or notepad and/or pocket calculator and/or calendar and/or mirror and/or miniature tools and/or manicure.

The first and the second hard shell consist of a hard or respectively rigid material, which is not or only insignificantly deformed under the usual loads to which the case is exposed, so that items disposed in the case are not damaged or destroyed. According to a preferred embodiment, the first and/or the second hard shell are composed of several shell parts. This permits to produce stable hard shells in a cost-saving manner, which have a pleasant outer appearance.

According to a further embodiment, the first and/or the second hard shells as a whole, or at least a shell portion of the first and/or the second hard shell consists of plastics and/or metal and/or leather. The metal is for instance aluminium or an aluminium alloy. The plastics of the first and/or the second hard shell is preferably a hard plastics. The plastics can be a fibre composite material. It can be a plastics reinforced by carbon or glass fibres in particular. An inner shall portion is made of plastics, and an outer shell portion of metal or leather. An inner shell part is preferably made of plastics, and an outer shell part of metal or leather.

According to a preferred embodiment, the first and/or the second hard shell has an inner shell of plastics, and an outer shell of aluminium or an aluminium alloy or of leather.

According to a further embodiment, the centre part consists of plastics and/or metal.

Finally, according to one embodiment, the base area of the case is adapted to the card dimensions and/or has billfold size and/or wallet size. When it is adapted to the card format, the base area of the case exceeds the format of a standard cheque card or standard visiting card or the multiplicate format of a standard cheque card or standard visiting card only to a small extent. As a consequence, plastic cards can be housed in the case in a space-saving manner. When adapted to the billfold format and/or the wallet format, utilisation of the case as a billfold or wallet is favoured.

The present invention will be explained by way of examples of its realisation, which are depicted in the attached drawings. In the drawings show:

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated In the present application, the designations "up" and "down" refer to the orientation of the case with the first hard shell down and the second hard shell up, wherein the outer side of the first shell bottom of the first hard shell is oriented horizontally. As the longitudinal direction, it is intended to designate an axis vertical to the axis of the joint, and as transverse axis an axis in the direction of the axis of the joint.

In the explanations of different realisation examples, coincident or essentially coincident parts are provided with the same reference numbers.

Figure 1:
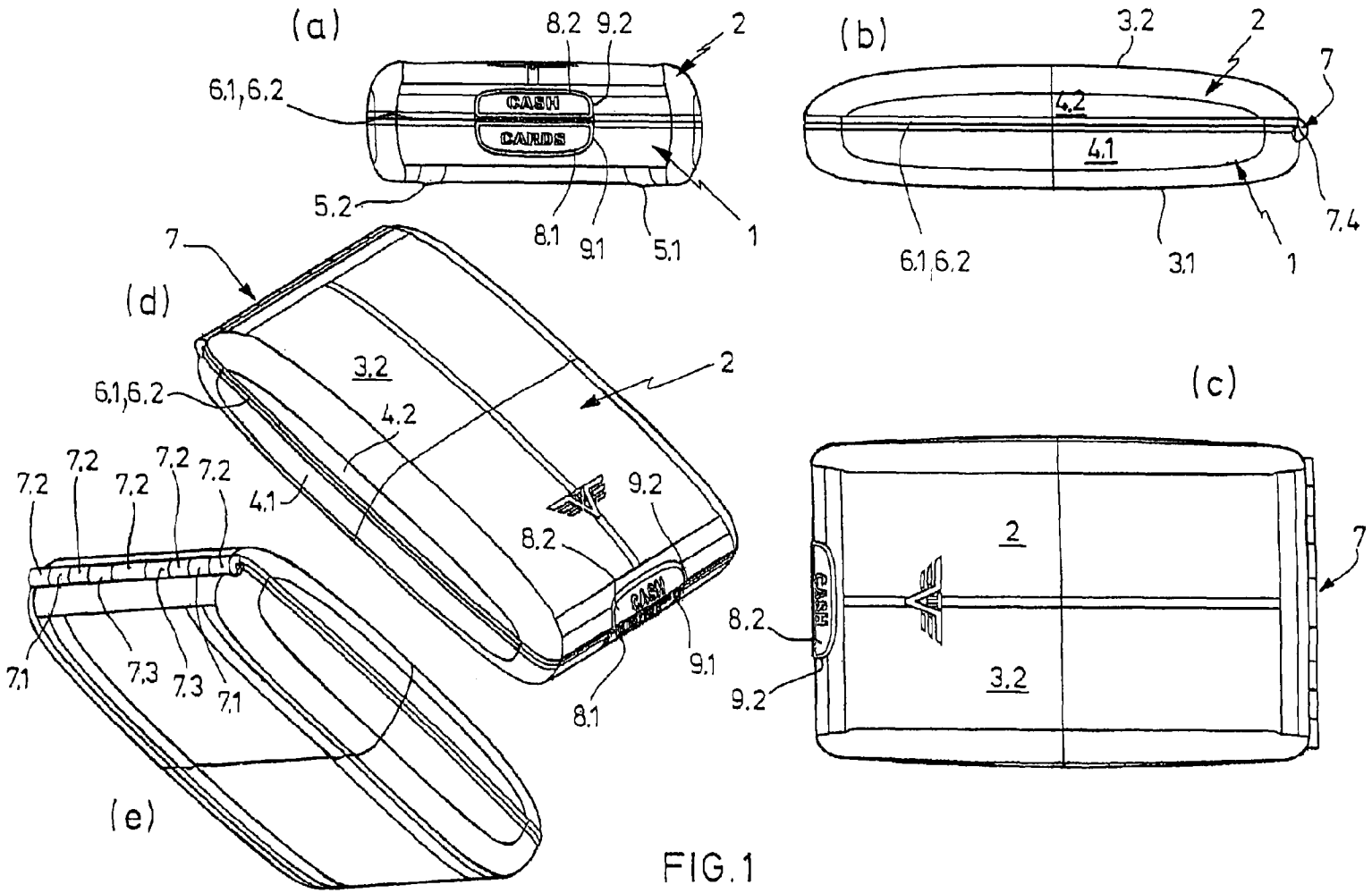
FIG. 1*a* to 1*e* a case for money and plastic cards in a front view (FIG. 1*a*), view from the left side (FIG. 1*b*), top view (FIG. 1*c*), perspective view obliquely from the upper side and from the left side (FIG. 1*d*), and perspective view obliquely from the downside and from the left side (FIG. 1*e*)

According to FIG. 1, the case has a first hard shell 1 and a second hard shell 2. In the example, the hard shells 1, 2 consist only of an inner shell 1.1, 2.1 made of hard plastics, and an outer shell 2.1, 2.2 made of aluminium, preferably brushed aluminium (compare FIGS. 5 to 8).

The first hard shell 1 has a first shell bottom 3.1 for setting it on planar ground, and a circumferential first shell edge 4.1. The second hard shell 2 has a second shell bottom 3.2 and a circumferential second shell edge 4.2. The first shell bottom 3.1 is essentially planar, and at the outer side it bears two supporting ribs 5.1, 5.2 extending in the longitudinal direction. On the longitudinal sides, the first shell bottom 3.1 merges into the first shell edge 4.1 via a radius. At the front sides, the first shell edge 4.1 is altogether curved towards the first shell bottom 3.1. At the upside, the first shell edge 41. has a planar bearing surface 6.1.

The second shell bottom 3.2 is altogether convexly curved towards the upside, the curving to the second shell edge 4.2 increasing towards the front sides. At the long sides, the transition between the second shell edge 4.2 and the second shell bottom 3.2 has a radius. The lower edge of the second shell edge 4.2 has also a planar bearing surface 6.2.

At the front sides, the first hard shell 1 and the second hard shell 2 are pivotally connected to each other by means of a joint 7, which is designed as a piano-type joint. The joint comprises two first ears 7.1 at the upper edge of the first shell edge 4.1, and five second ears 7.2 at the lower edge of the second shell edge 4.2, which are offset from each other.

A first push button 8.1 and a second push button 8.2 are integrated into the first and second shell edges 4.1, 4.2 at the opposite front side. The first push button 8.1 and the second push button 8.2 respectively sit in a recess 9.1 in the first shell edge 4.1 and a recess 9.2 in the second shell edge 4.2, so that they do not project towards the outside, or only a little bit.

Figure 2:
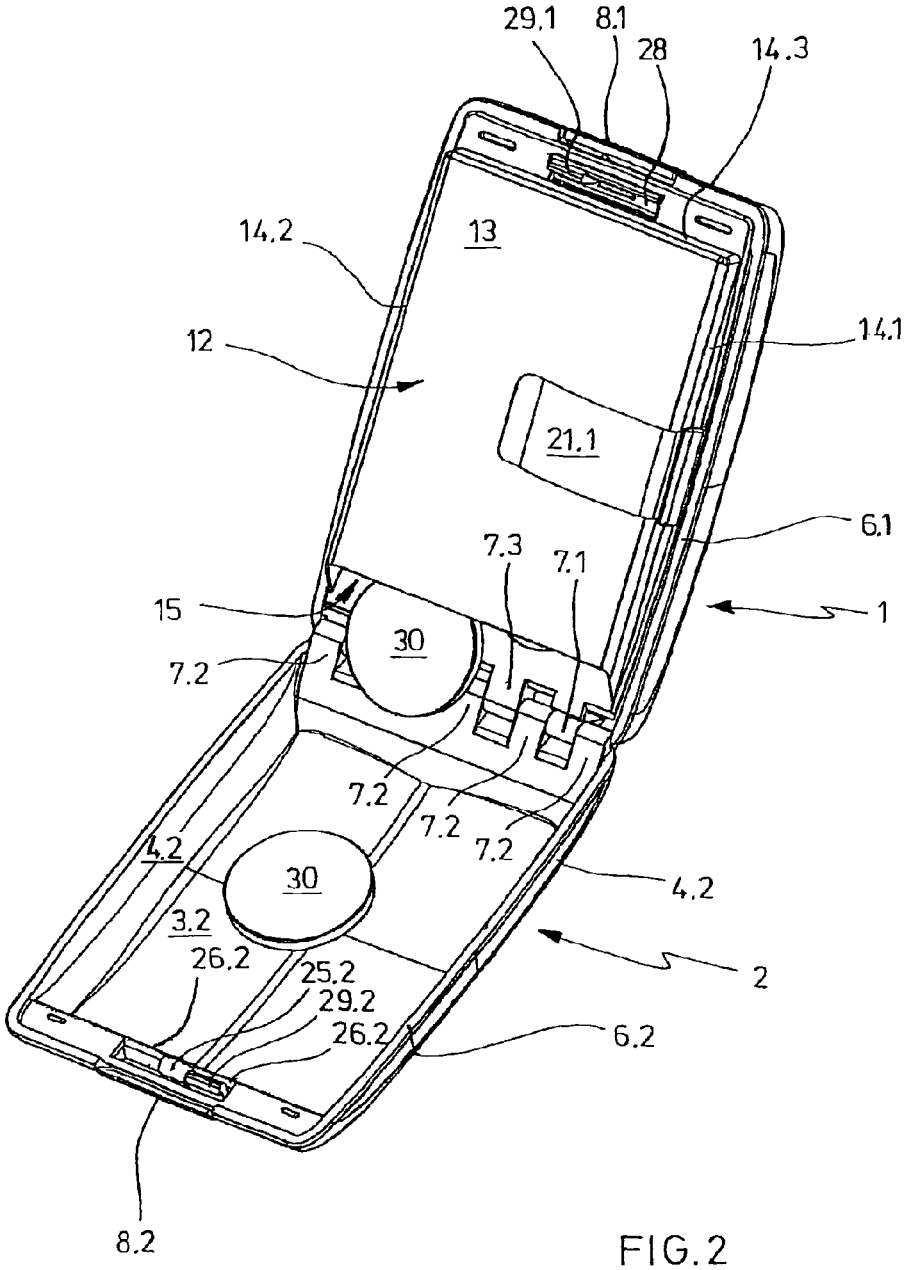
FIG. 2 the same case with swung up wallet portion in a perspective view obliquely from the upper side and from the left side.
Figure 3:
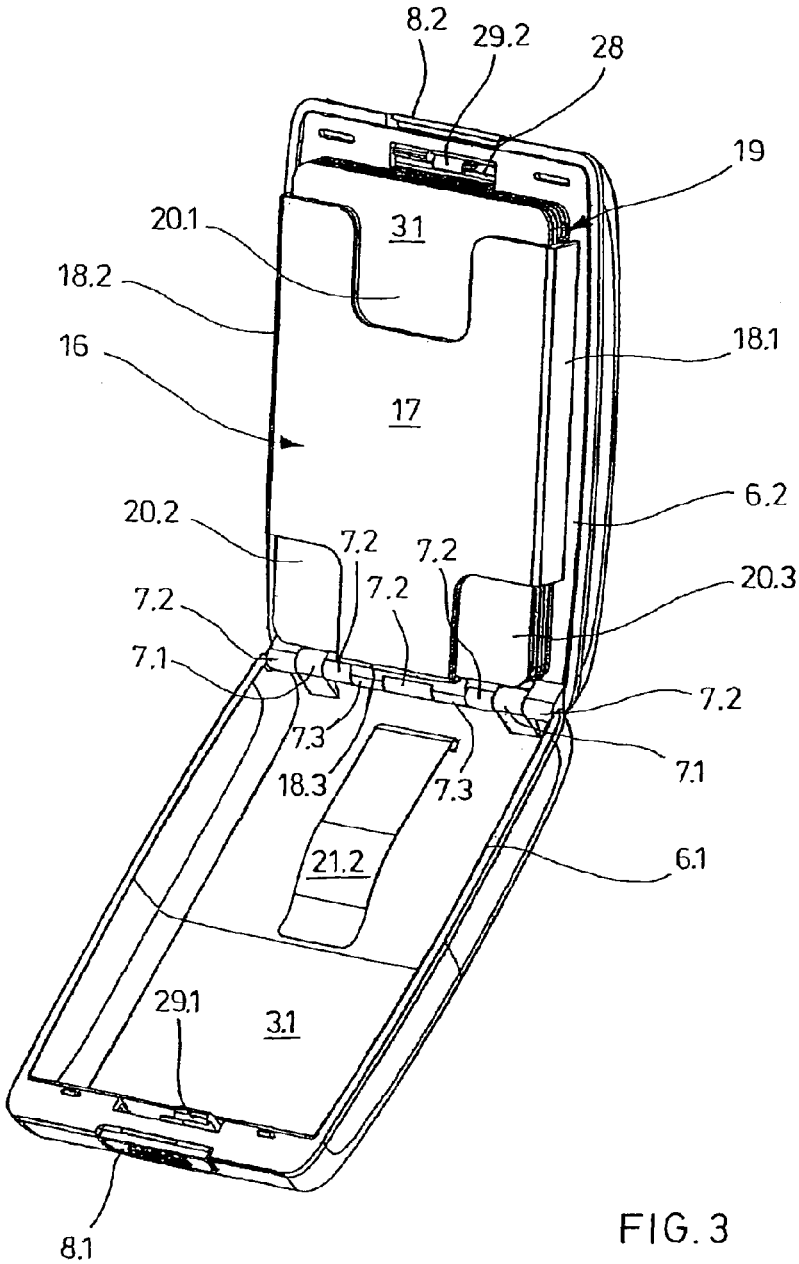
FIG. 3 the same case with swung up plastic card portion in a perspective view obliquely from the upper side and from the right side.
Figure 4:
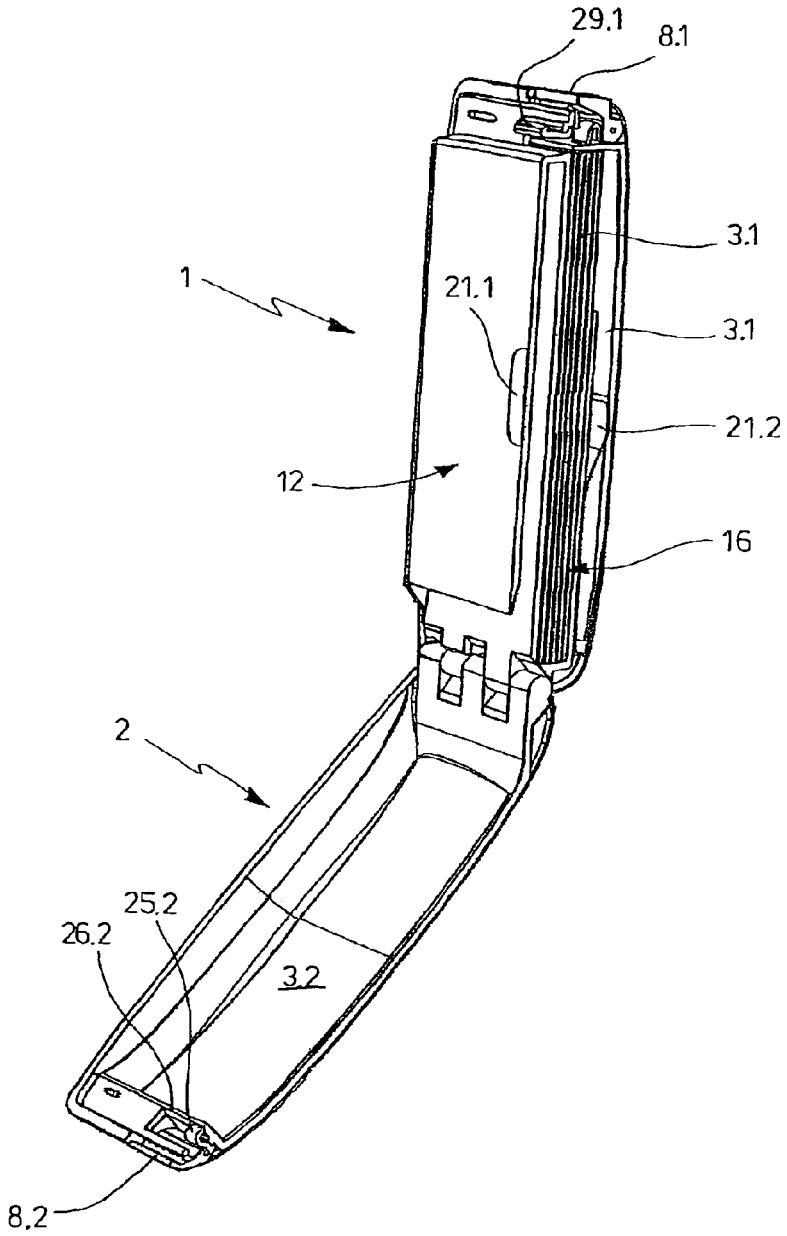
FIG. 4 the same case with swung up wallet portion in a longitudinal section.

According to FIGS. 2 to 4, a centre part 10 (or carrier 10) is disposed between the first and second hard shells 1, 2. In a central plane, the centre part 10 has a central wall 11, which has two third ears 7.3 of the joint 7 at a front side end. The third ears 7.3 are offset from the first and second ears 7.1, 7.2. The first, second and third ears 7.1, 7.2 and 7.3 are interleaved in a flush arrangement. A joint rod 7.4 is thrust through the openings of the ears 7.1, 7.2 and 7.3, so that the first and the second hard shell 1, 2 as well as the centre part 10 are pivotally connected to each other.

Complementary to the outer side, the inner side of the second hard shell 2 is vault-like. Adjacent to the second ears 7.2, the vault merges into an obliquely inclined even plane. The adjacent upper side of the third ears 7.3 is in the same plane as the central wall 11.

The centre part 10 has a box-shaped coin retaining compartment 12 for coins at an upper side. The coin retaining compartment 12 is encompassed by the central wall 11, an upper wall 13 parallel to the former, and by two long side and one front side first side walls 14.1, 14.2, 14.3. At the side neighbouring to the third ears 7.3, the first retaining compartment 12 has an oblong coin opening 15, which extends over its entire width and its entire height.

At the downside, the centre part 10 has a box-shaped card retaining compartment 16 for plastic cards. The same is encompassed by the central wall 11 and a parallel lower wall 17 in a distance to the former, as well as by two longitudinal and four transverse second side walls 18.1, 18.2, 18.3. At the end remote from the third ears 7.3, the card retaining compartment 16 has an oblong card opening 19, which extends over the entire width and height of the card retaining compartment 16.

Starting from the second opening 19, the lower wall 17 has an approximately rectangular recess 20.1, and next to the third ears 17.3 further recesses 20.2, 20.3 which extend into the long side and the front side side walls 18.1, 18.2 18.3. The centre part 10 is preferably produced from plastics in one piece by injection moulding.

A first clip 21.1 made of spring steel is disposed on the coin retaining compartment 12. The first clip 21.1 extends transversely across about the half width of the coin retaining compartment 12. Flat material can be clamped in between the first clip 21.1 and the upper wall 13.

A second clip 21.2 extending in the longitudinal direction, made from spring steel, is disposed on the first shell bottom 3.1. Flat material can be clamped in between the second clip 21.2 and the first shell bottom 3.1.

In the closed condition, the case has the format of a wallet for men.

Figure 5:
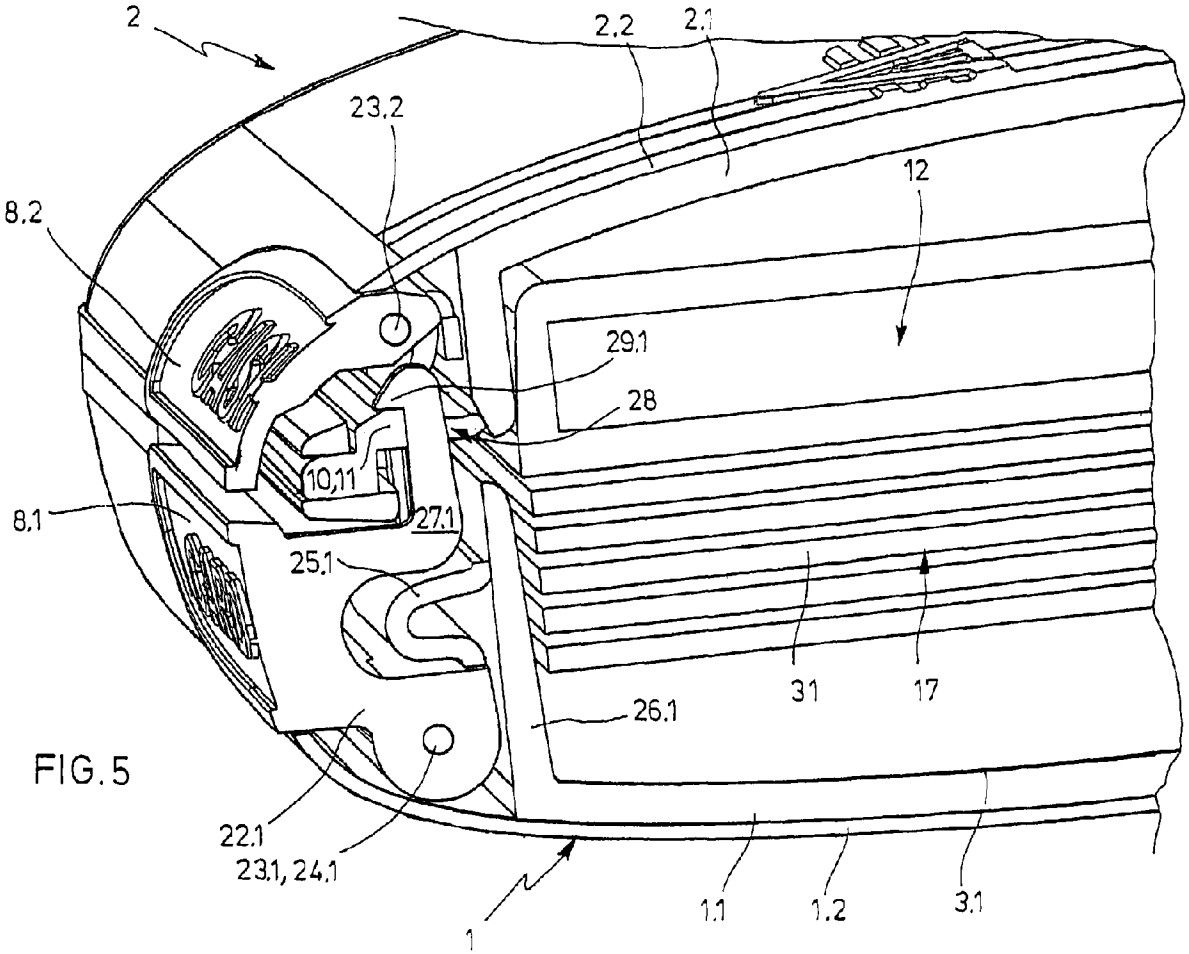
FIG. 5 the same case in the closed condition in a partial longitudinal section through the locking mechanism for the plastic card portion.

According to FIG. 5, the first push button 8.1 is provided in one piece with a lever arm 21.1, which is bearing mounted on a first bearing pin 24.1 in a first pivot bearing 23.1. Adjacent to this, it is connected in one piece to a first flexible spring 25.1, which is supported on a first partition wall 26.1 that projects upward from the first shell bottom 3.1. Further, the first push button 8.1 is connected in one piece to a first angled engagement hook 27.1, which grips through a slit 28 in the central wall 11 and sits up on the upper side of the central wall 11 with a first hook end 29.1.

Figure 6:
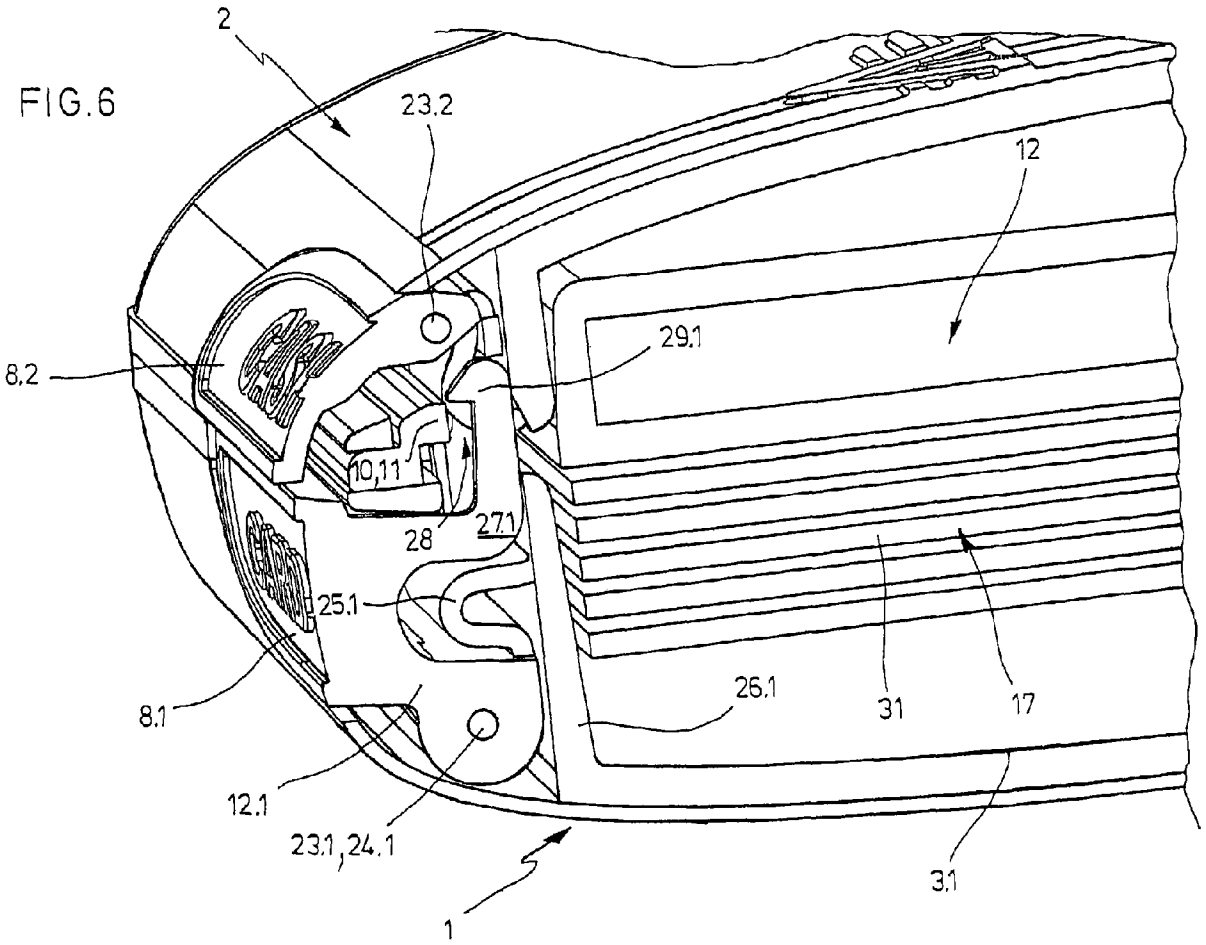
FIG. 6 the same case with actuated first push button for the plastic card portion in the same longitudinal section through the locking mechanism.

According to FIG. 6, the first push button 8.1 can be actuated against the spring action of the first flexible spring 25.1, so that the first hook end 29.1 is released and the first and the second hard shells 1, 2 can be unfolded.

Figure 7:
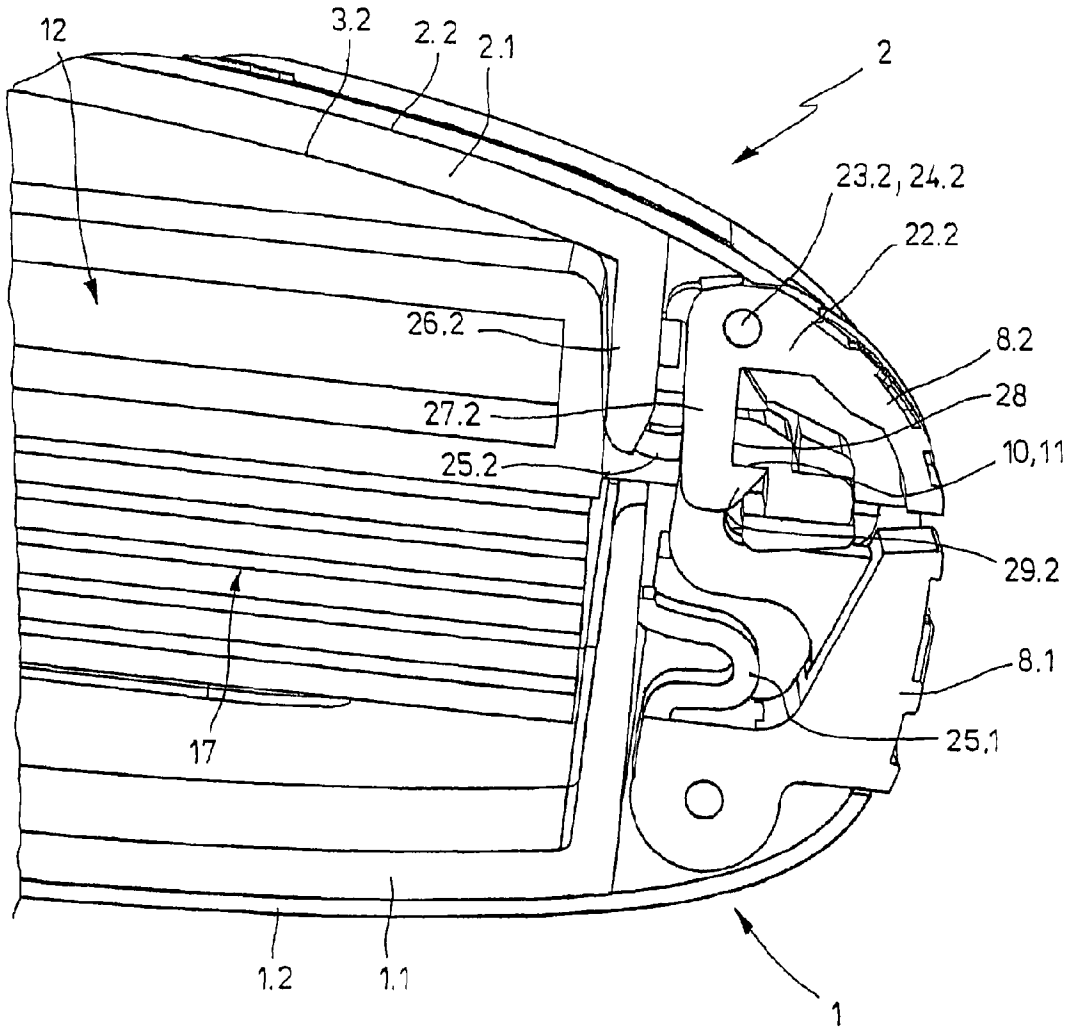
FIG. 7 the same case in the closed condition in a longitudinal section through the locking mechanism for the wallet portion.

According to FIG. 7, the second push button 8.2 is provided with a second lever arm 22.2 in one piece, which is bearing mounted in a second pivot bearing 23.2. The second pivot bearing 23.2 has a second bearing pin 24.2, which is fixedly connected to the second hard shell 2. On the other side of the second pivot bearing 23.2, the second lever arm 22.2 is connected in one piece to a second flexible spring 25.2, which is supported on a second partition wall 26.2 that projects downward from the second shell bottom 3.2. Further, also on the other side of the pivot bearing 23.2, the second push button 8.2 is connected in one piece to a second angled engagement hook 27.2, which is disposed next to the second flexible spring 25.2, grips through the slit 28 in the centre part 11 and sits up on the lower side of the central wall 11 with a second hook end 29.2 (compare FIGS. 2, 4).

Figure 8:
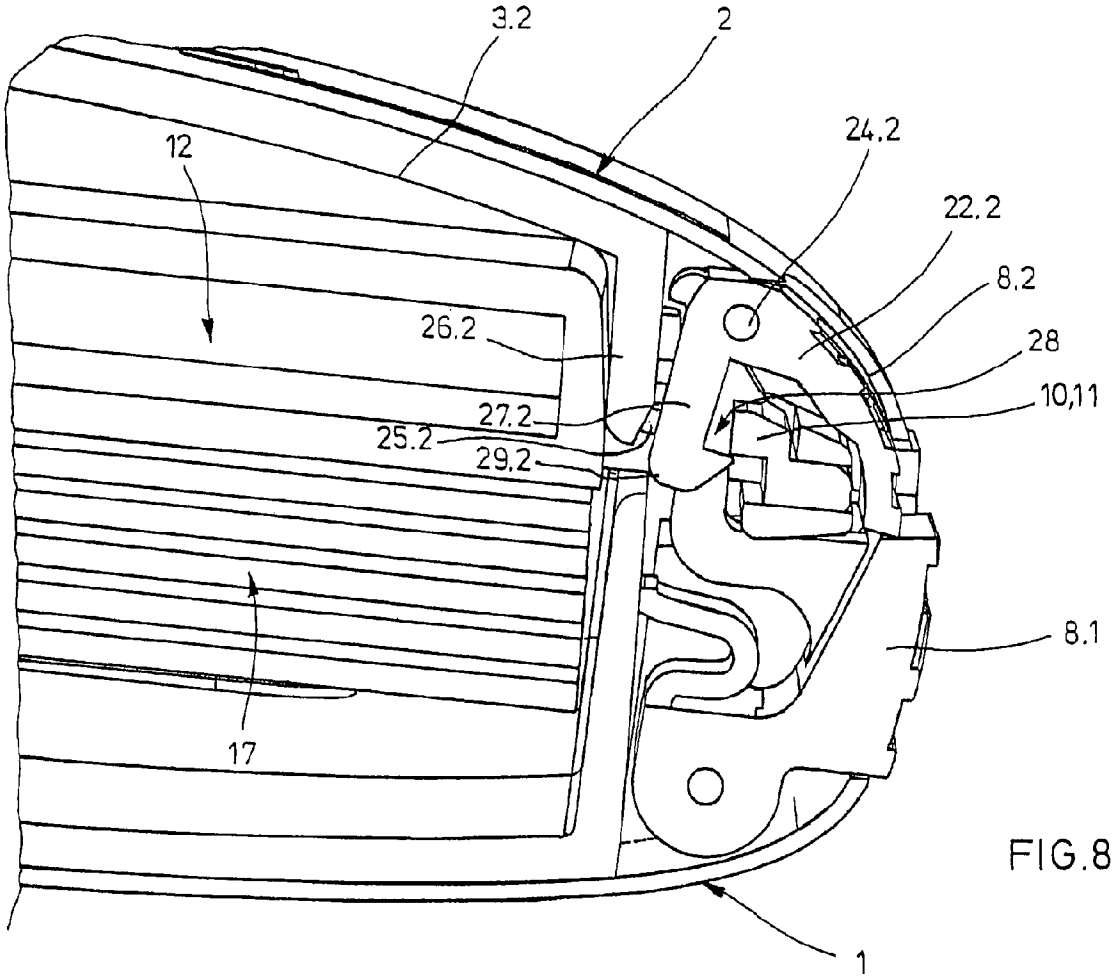
FIG. 8 the same case with actuated push button for the wallet portion in the same longitudinal section through the locking mechanism.
Figure 9A:
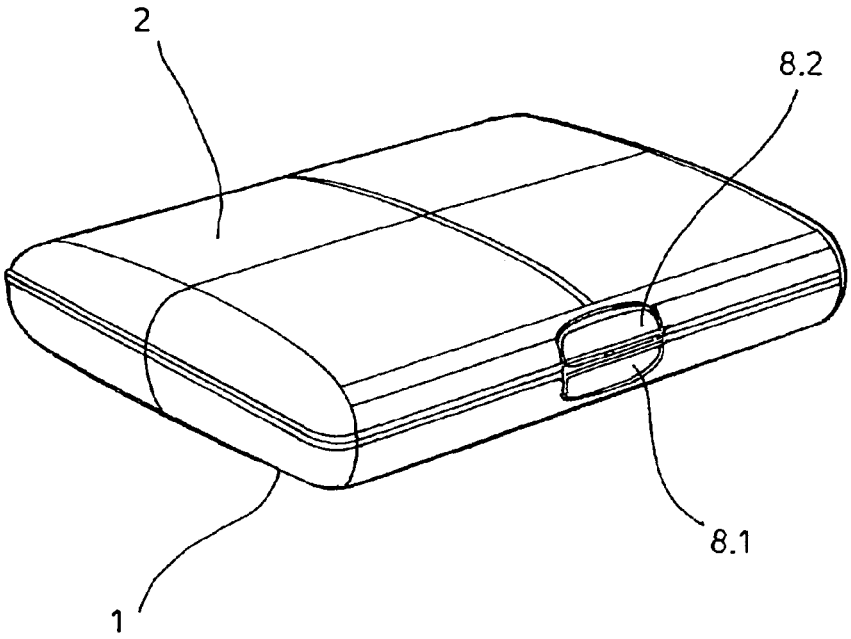
FIGS. 9*a* to 9*c* a case for documents and plastic cards in a perspective view obliquely from the upper side and from the left side (FIG. 9*a*), in a perspective view obliquely from the downside from the right side (FIG. 9*b*) and in a view from the right side (FIG. 9*c*)
Figure 9B:
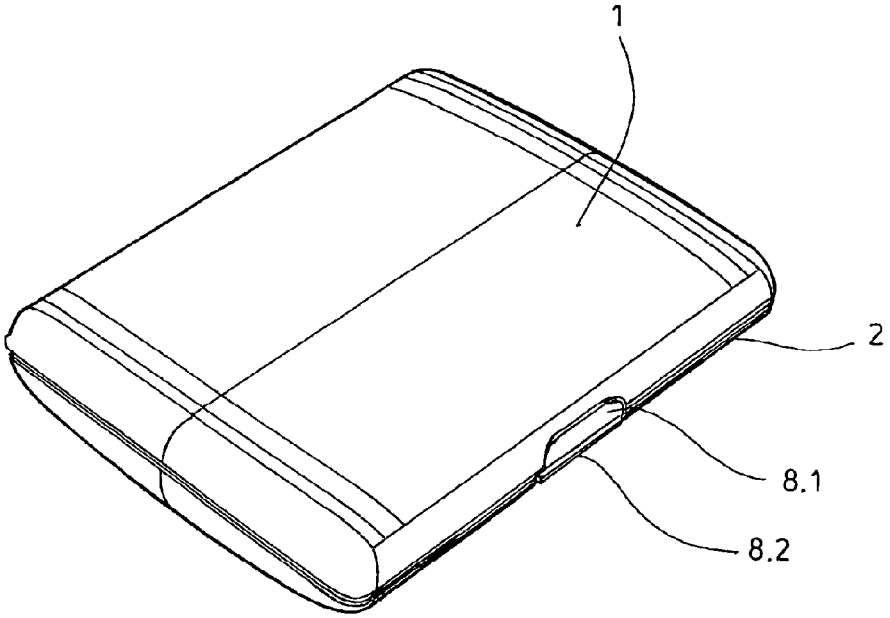
Figure 9C:
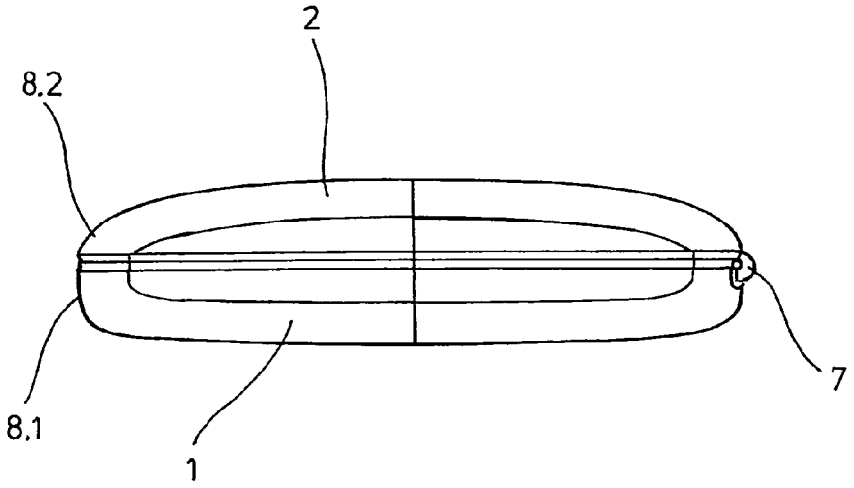
Figure 10:
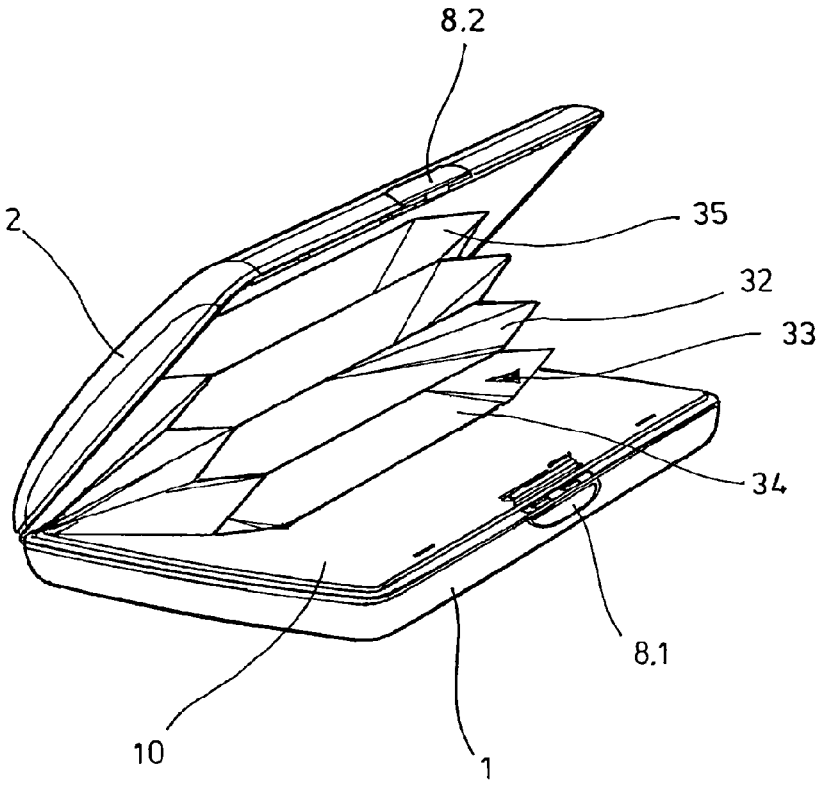
FIG. 10 the same case with swung up document portion in a perspective view obliquely from the upper side and from the left side.
Figure 11:
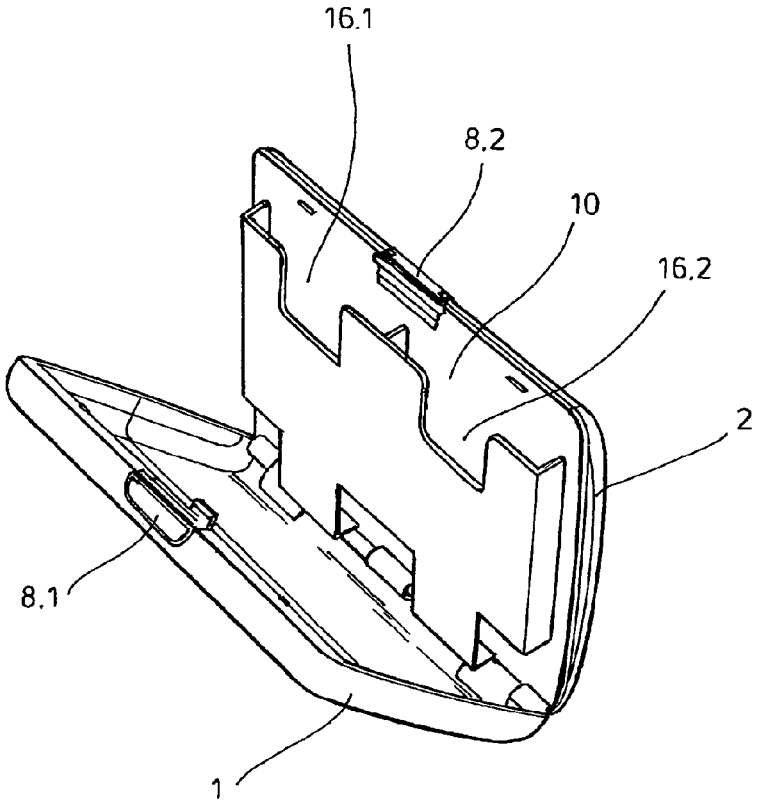
FIG. 11 the same case with swung up plastic card portion in a perspective view obliquely from the upper side and from the right side.
Figure 12:
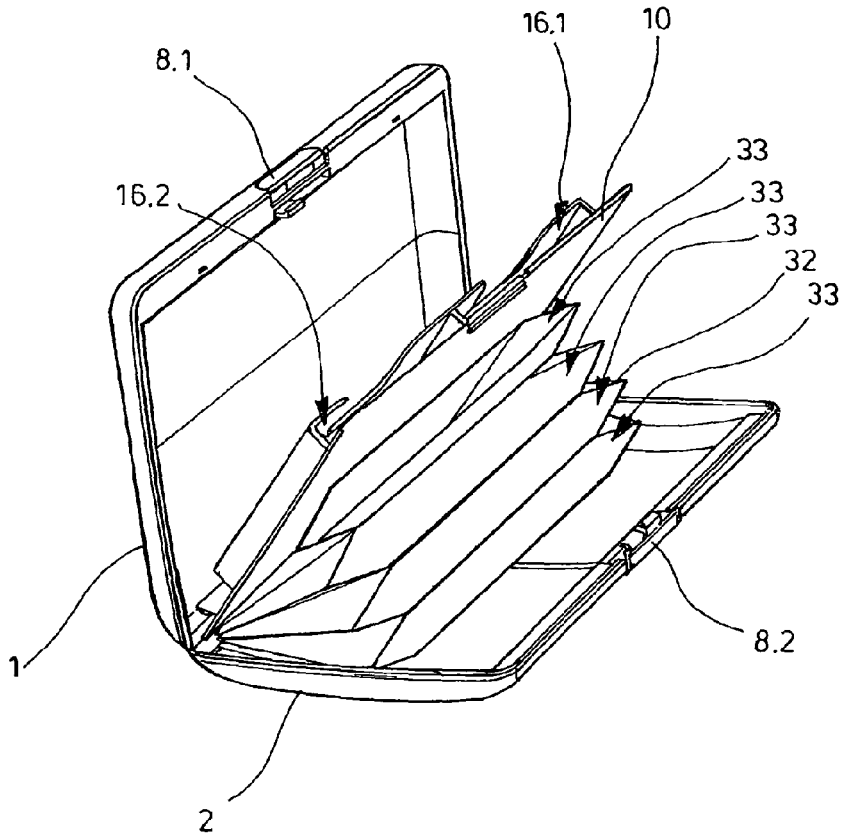
FIG. 12 the same case with swung up document- and plastic card portion in a perspective view obliquely from the upper side and from the right side.
Figure 13:
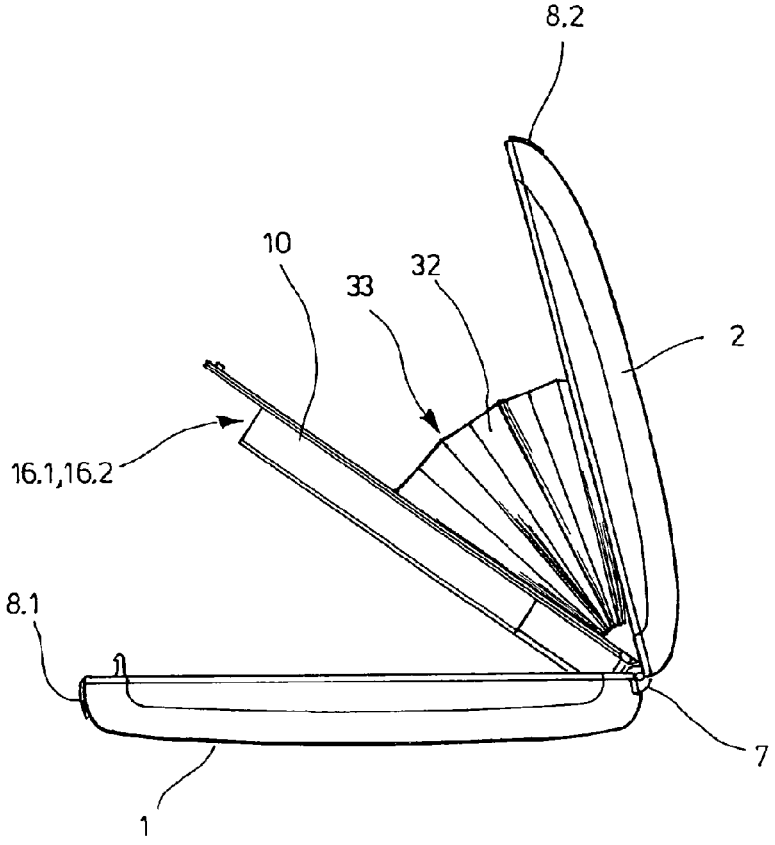
FIG. 13 the same case with swung up document- and plastic card portion in a view o from the right side.

According to FIG. 8, the second push button 8.2 can be pressed in against the spring action of the second flexible spring 25.2, wherein the second hook end 29.2 is released and the first hard shell can be swung away from the second hard shell 2.

FIG. 2 shows the case after the actuation of the second push button 8.2 and after swinging up the first hard shell 1 with respect to the second hard shell 2. The centre part 10 swings along in this process, because it is locked to the first hard shell 1 by means of the first engagement hook 27.1. Across the ears 7.1, 7.2, 7.3, which are closely interlocked and smooth at the inner sides, coins 30 slip through the first opening 15 of the coin retaining compartment 12 to the inner side of the second hard shell 2 maximally up to the partition wall 26.2, which forms a shoulder for stopping the coins. Single coins 30 can be easily picked up there. Reversely, coins 30 can be filled into the second hard shell 2. By lowering the first hard shell 1 and lifting the second hard shell 2, it is achieved that the coins 30 slip from the second hard shell 2 into the coin retaining compartment 12 through the first opening 15. The case is subsequently closed by swinging the second hard shell 2 against the first hard shell 1, until the second engagement hook 27.2 grips through the slit 28, and the second hook end 29.2, driven by the second flexible spring 25.2, grips over the upper side of the central wall 11.

When the first push button 8.1 is actuated, the second hard shell 2 can be swung upward with respect to the first hard shell 1, as shown in FIG. 3. In this, the card retaining compartment 16 is swung along towards the upside, because the centre part 10 is locked to the second hard shell 2 by means of the second engagement hook 27.2. In this position, plastic cards 31 can be taken out of the second opening 19 from a stack which is inserted into the card retaining compartment 16. The user can grasp through the recesses 20.1, 20.2, 20.3 with the finger, and fan out the plastic cards 31, or press out individual ones, respectively. Reversely, the user can insert plastic cards 31 into the card retaining compartment 16 through the second opening 19.

By swinging the hard shells 1, 2 together, the case is closed, wherein the first hook end 29.1 snaps behind the lower side of the central wall 11 through the slit.

The case of FIGS. 9 to 13 differs from the above-described case in particular in that a multi-compartment folder 32 for documents exists between the centre part 10 and the second hard shell 2. In the example, the multi-compartment folder 32 has four pockets 33, which are connected to each other like a bellows. The outer pocket walls 34, 35 of the outer pockets 33 are glued to the centre part 10 and the inner side of the second hard shell 2, respectively. The document portion of this case can be opened by actuating the push button 8.2 "PAPERS". The mechanism for locking and for opening of this push button 8.2 corresponds to that of the push button 8.2 "CASH" of the foregoing realisation example.

Further, this case differs from that one described above in that the centre part 10 has two neighbouring box-like card retaining compartments 16.1, 16.2 for plastic cards at its downside. As a consequence, the base surface area of this case is about twice that of the case above. Accordingly, the case of FIGS. 9 to 13 has about twice the accommodation capacity for plastic cards than the case described in the beginning. The card retaining compartments 16.1, 16.2 can be opened by pressing the push button 8.1 "Cards". The mechanism for locking and for opening of the push button 8.1 "Cards" corresponds to that of the push button 8.1 in the case of FIGS. 1 to 8. Even with respect to the design of the card retaining compartments 16.1, 16.2, the joint 7, the hard shells 1, 2 and other details, the case of FIGS. 9 to 13 corresponds to the case of FIGS. 1 to 9.

Figure 14:
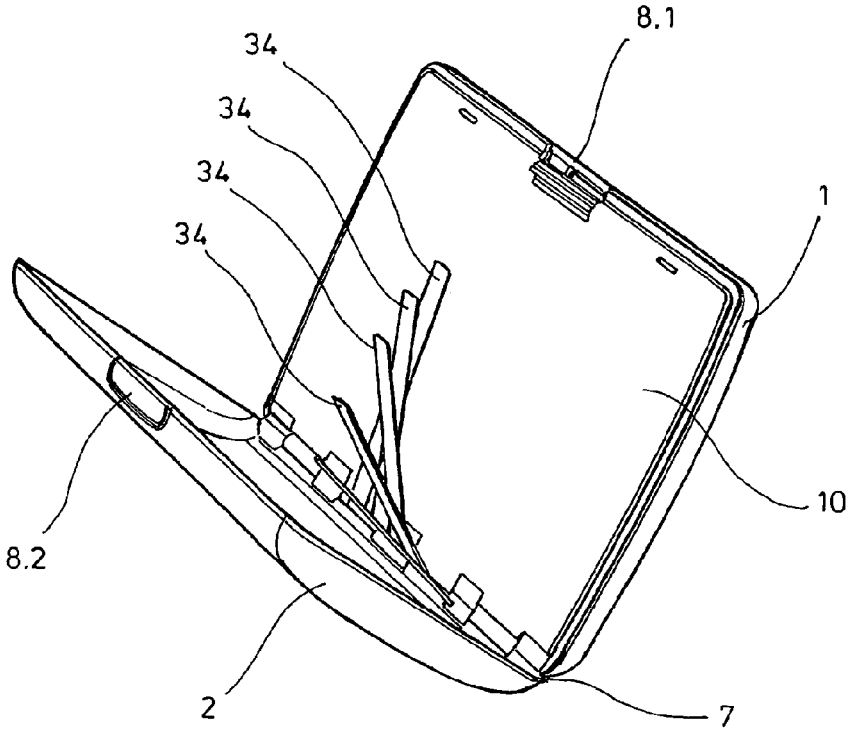
FIG. 14 a case with fingers for retaining documents in the opened condition, in a perspective view obliquely from the upper side and from the right side.
Figure 15:
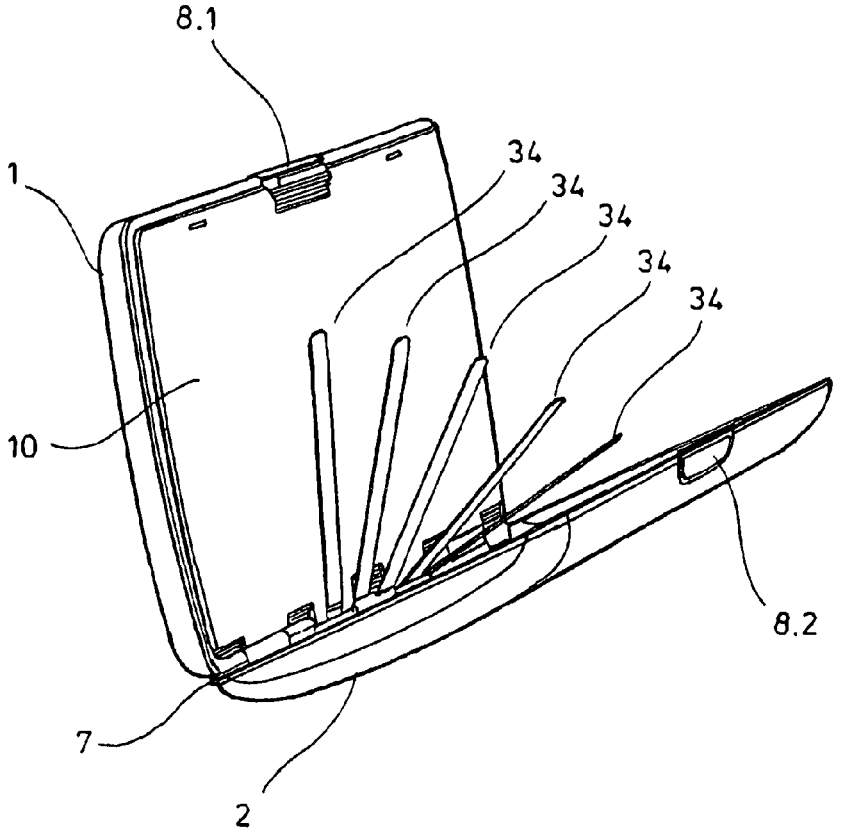
FIG. 15 the same case when opened, in a perspective view obliquely from the upper side and from the left side.

The case of FIGS. 14 and 15 differs from that one described above in that fingers 34 exist instead of the multi-compartment folder, which are pivotally connected to the joint 7 by means of hinge eyes. Four fingers 34 are shown in the example. The fingers can consist of a rigid and an elastic material, for instance of plastics or a metal. Documents (for instance identity card, driving license, banknotes and receipts) can be clamped in between the fingers 34 or between the fingers 34 and the centre part 10 or the second hard shell 2, respectively. Take-along devices can exist between the fingers 34, so that by swinging the uppermost finger 34 upward, the subsequent fingers 34 are successively taken along and arrive in the positions shown in FIGS. 14 and 15 in order to insert or take out documents, respectively.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A case for coins or plastic cards or documents or similar objects, comprising:

a first and a second hard shell (1, 2), a joint (7), pivotally connecting the first and the second hard shell (1, 2) with each other at edges thereof, the shells (1, 2) being so designed to pivot about the joint (7) into a closed position, a center part (10) which is pivotally connected to the first and the second hard shell (1, 2) by means of the joint (7), the center part being designed to accommodate one or more coins, plastic cards, and other items to be inserted therein or taken therefrom, the first and second shells enclosing the center part in the closed position, means for selectively locking (27, 28) the center part (10) to the first hard shell (1) and to the second hard shell (2), wherein at least one shell part of the first hard shell (1) and at least one shell part of the second hard shell (2) consist of metal.

2. The case according to claim 1, further wherein the center part is configured for coins and includes a coin retaining compartment (12) having a coin opening (15) at the side of the joint (7).

3. The case according to claim 2, wherein the coin opening (15) is oblong.

4. The case according to claim 2, wherein the second hard shell locks up the coin opening (15) in the closed position.

5. The case according to claim 2, wherein the coin retaining compartment (12) is box-shaped.

6. The case according to claim 2, wherein the coin opening (15) is not covered up by a first shell edge (3.2) of the first hard shell (1).

7. The case according to claim 2, wherein a first clip (21.1) is disposed on that side of the coin retaining compartment (12) which faces the second hard shell (2).

8. The case according to claim 2, wherein the coin retaining compartment (12) is disposed on a first side of the center part (10).

9. The case according to claim 1, wherein the second hard shell (2) has a smooth transition towards the joint (7) at the inner side, and/or has a shoulder at the opposite end.

10. The case according to claim 1, wherein the second hard shell (2) is flattened at the outer side towards the joint (7) and/or towards the opposite end.

11. The case according to claim 1, wherein a first clip (21.1) butts under prestress against the inner side of the second hard shell (2) in the closed position.

12. The case according to claim 1, wherein the means for locking (27, 28) have at least one engagement hook (27) and at least one engagement contour (28) that can be brought into engagement therewith, at least one spring means (25) for loading the engagement hook into the engagement position, and at least one press button (8) for disengaging the engagement hook (27) from the engagement contour (28).

13. The case according to claim 1, wherein the means for locking (27, 28) have a first press button (8.1), which is pivotally mounted in the first hard shell (1) on a first hinge bearing (23.1), a second press button (8.2), which is pivotally mounted in the second hard shell (2) on a second hinge bearing (23.2), a first engagement hook (27.1) rigidly connected to the first press button (8.1) and being loaded into engagement position with a first engagement contour (28) on the center part (10) by means of first spring means (25.1), a second engagement hook (27.2) rigidly connected to the second press button (8.2) and being loaded into engagement position with a second engagement contour (28) on the center part (10) by means of second spring means (25.2), so that the first engagement hook (27.1) can be brought into disengagement from the first engagement contour (28) by actuating the first press button (8.1) against the spring action of the first spring means (25.1), and the second engagement hook (27.2) can be brought into disengagement from the second engagement contour (28) by actuating the second press button (8.2) against the spring action of the second spring means (25.2).

14. The case according to claim 13, wherein the first spring means (25.1) is supported on the first hard shell (1), and the second spring means is supported on the second hard shell (2).

15. The case according to claim 1, wherein the first and/or the second hard shell (1, 2) are composed of several shell parts.

16. The case according to claim 1, whose base area is adapted to the card dimensions and/or which is billfold size and/or is wallet size.

* * * * *